US008173339B2

(12) United States Patent
Takeda

(10) Patent No.: US 8,173,339 B2
(45) Date of Patent: May 8, 2012

(54) ELECTROPHOTOGRAPHIC APPARATUS, ELECTROPHOTOGRAPHIC PHOTOCONDUCTOR DRUM, DEVELOPING DEVICE AND IMAGE FORMING DEVICE

(75) Inventor: Makoto Takeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 468 days.

(21) Appl. No.: 12/453,028

(22) Filed: Apr. 28, 2009

(65) Prior Publication Data

US 2009/0317734 A1 Dec. 24, 2009

(30) Foreign Application Priority Data

Jun. 23, 2008 (JP) ..... 2008-163203

(51) Int. Cl.
*G03G 5/00* (2006.01)

(52) U.S. Cl. ..... 430/56; 430/58.05; 430/69

(58) Field of Classification Search ..... 430/56, 430/58.05, 60, 66, 67, 69; 399/159, 276
See application file for complete search history.

(56) References Cited

U.S. PATENT DOCUMENTS

| | | | | |
|---|---|---|---|---|
| 7,358,018 | B2 * | 4/2008 | Taguchi | 430/69 |
| 2004/0023140 | A1 * | 2/2004 | Kawamura et al. | 430/66 |
| 2005/0255393 | A1 * | 11/2005 | Nakata et al. | 430/56 |

FOREIGN PATENT DOCUMENTS

JP A-2002-318459 10/2002

* cited by examiner

*Primary Examiner* — Mark F Huff
*Assistant Examiner* — Stewart Fraser
(74) *Attorney, Agent, or Firm* — Posz Law Group, PLC

(57) ABSTRACT

An electrophotographic apparatus includes a photoconductor, a plurality of a series of bump portions formed on a surface of the photoconductor, the bump portions having slopes with respect to a circumferential direction of the photoconductor, and each of the bump portions being spaced apart by a predetermined interval from adjacent bump portions with respect to the circumferential direction.

18 Claims, 14 Drawing Sheets

Fig.1A
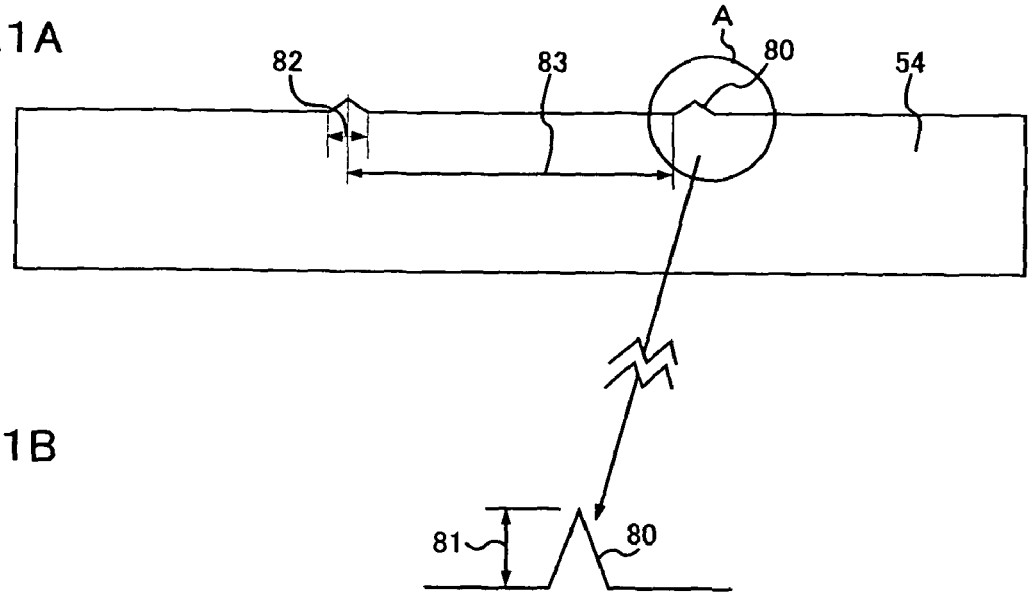
Fig.1B
Fig.2
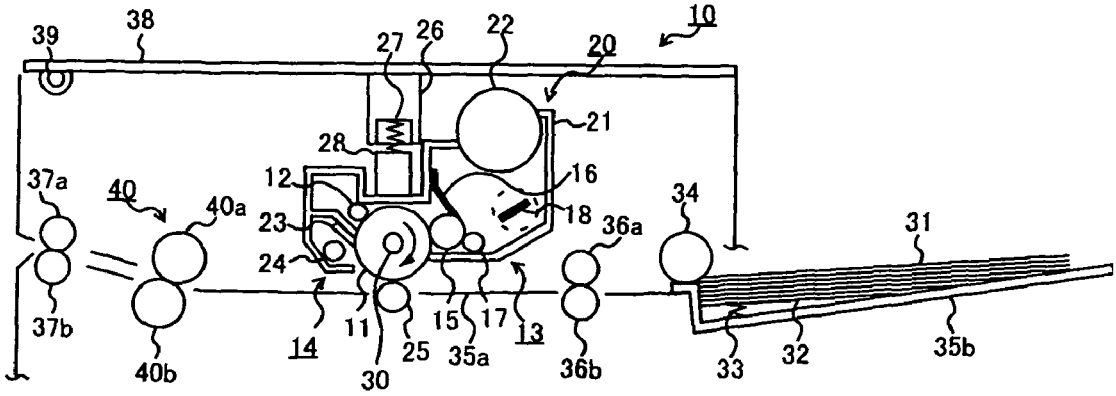

Fig.10

| No. | BUMP HEIGHT [μm] | BUMP WIDTH [μm] | BUMP INTERVAL [μm] | IMAGE QUALITY | | JUDGEMENT |
|---|---|---|---|---|---|---|
| | | | | FILMING | PARTIAL DISCOLORATION ETC | |
| 1 | 0.2 | 20 | 40 | × | × | × |
| 2 | 0.5 | 20 | 40 | × | ○ | × |
| 3 | 1.0 | 20 | 40 | × | ◎ | × |
| 4 | 1.5 | 20 | 40 | × | ◎ | × |
| 5 | 2.0 | 20 | 40 | × | ○ | × |
| 6 | 2.5 | 20 | 40 | × | × | × |
| 7 | 0.2 | 20 | 70 | ○ | × | × |
| 8 | 0.5 | 20 | 70 | ○ | ○ | ○ |
| 9 | 1.0 | 20 | 70 | ○ | ◎ | ○ |
| 10 | 1.5 | 20 | 70 | ○ | ◎ | ○ |
| 11 | 2.0 | 20 | 70 | ○ | ○ | ○ |
| 12 | 2.5 | 20 | 70 | ○ | × | × |
| 13 | 0.2 | 20 | 90 | ◎ | × | × |
| 14 | 0.5 | 20 | 90 | ◎ | ○ | ○ |
| 15 | 1.0 | 20 | 90 | ◎ | ◎ | ◎ |
| 16 | 1.5 | 20 | 90 | ◎ | ◎ | ◎ |
| 17 | 2.0 | 20 | 90 | ◎ | ○ | ○ |
| 18 | 2.5 | 20 | 90 | ◎ | × | × |
| 19 | 0.2 | 20 | 120 | ◎ | × | × |
| 20 | 0.5 | 20 | 120 | ◎ | ○ | ○ |
| 21 | 1.0 | 20 | 120 | ◎ | ◎ | ◎ |
| 22 | 1.5 | 20 | 120 | ◎ | ◎ | ◎ |
| 23 | 2.0 | 20 | 120 | ◎ | ○ | ○ |
| 24 | 2.5 | 20 | 120 | ◎ | × | × |
| 25 | 0.2 | 20 | 140 | ○ | × | × |
| 26 | 0.5 | 20 | 140 | ○ | ○ | ○ |
| 27 | 1.0 | 20 | 140 | ○ | ◎ | ○ |
| 28 | 1.5 | 20 | 140 | ○ | ◎ | ○ |
| 29 | 2.0 | 20 | 140 | ○ | ○ | ○ |
| 30 | 2.5 | 20 | 140 | ○ | × | ○ |
| 31 | 0.2 | 20 | 160 | × | × | × |
| 32 | 0.5 | 20 | 160 | × | ○ | × |
| 33 | 1.0 | 20 | 160 | × | ◎ | × |
| 34 | 1.5 | 20 | 160 | × | ◎ | × |
| 35 | 2.0 | 20 | 160 | × | ○ | × |
| 36 | 2.5 | 20 | 160 | × | × | × |

| No. | BUMP HEIGHT 〔μm〕 | BUMP WIDTH 〔μm〕 | BUMP INTERVAL 〔μm〕 | IMAGE QUALITY | | JUDGEMENT |
|---|---|---|---|---|---|---|
| | | | | FILMING | PARTIAL DISCOLORATION ETC. | |
| 1 | 1.0 | 5 | 200 | × | ◎ | × |
| 2 | 1.0 | 10 | 200 | ○ | ◎ | ○ |
| 3 | 1.0 | 20 | 200 | ◎ | ◎ | ◎ |
| 4 | 1.0 | 50 | 200 | ◎ | ◎ | ◎ |
| 5 | 1.0 | 70 | 200 | ○ | ◎ | ○ |
| 6 | 1.0 | 100 | 200 | × | ◎ | × |

Fig.17

| No. | BUMP HEIGHT [μm] | BUMP WIDTH [μm] | BUMP INTERVAL [μm] | IMAGE QUALITY | | JUDGEMENT |
|---|---|---|---|---|---|---|
| | | | | FILMING | PARTIAL DISCOLORATION ETC. | |
| 1 | 0.2 | 20 | 40 | × | × | × |
| 2 | 0.5 | 20 | 40 | × | ○ | × |
| 3 | 1.0 | 20 | 40 | × | ◎ | × |
| 4 | 1.5 | 20 | 40 | × | ◎ | × |
| 5 | 2.0 | 20 | 40 | × | ○ | × |
| 6 | 2.5 | 20 | 40 | × | × | × |
| 7 | 0.2 | 20 | 70 | ○ | × | × |
| 8 | 0.5 | 20 | 70 | ○ | ○ | ○ |
| 9 | 1.0 | 20 | 70 | ○ | ◎ | ○ |
| 10 | 1.5 | 20 | 70 | ○ | ◎ | ○ |
| 11 | 2.0 | 20 | 70 | ○ | ○ | ○ |
| 12 | 2.5 | 20 | 70 | ○ | × | × |
| 13 | 0.2 | 20 | 90 | ◎ | × | × |
| 14 | 0.5 | 20 | 90 | ◎ | ○ | ○ |
| 15 | 1.0 | 20 | 90 | ◎ | ◎ | ◎ |
| 16 | 1.5 | 20 | 90 | ◎ | ◎ | ◎ |
| 17 | 2.0 | 20 | 90 | ◎ | ○ | ○ |
| 18 | 2.5 | 20 | 90 | ◎ | × | × |
| 19 | 0.2 | 20 | 120 | ◎ | × | × |
| 20 | 0.5 | 20 | 120 | ◎ | ○ | ○ |
| 21 | 1.0 | 20 | 120 | ◎ | ◎ | ◎ |
| 22 | 1.5 | 20 | 120 | ◎ | ◎ | ◎ |
| 23 | 2.0 | 20 | 120 | ◎ | ○ | ○ |
| 24 | 2.5 | 20 | 120 | ◎ | × | × |
| 25 | 0.2 | 20 | 140 | ○ | × | × |
| 26 | 0.5 | 20 | 140 | ○ | ○ | ○ |
| 27 | 1.0 | 20 | 140 | ○ | ◎ | ○ |
| 28 | 1.5 | 20 | 140 | ○ | ◎ | ○ |
| 29 | 2.0 | 20 | 140 | ○ | ○ | ○ |
| 30 | 2.5 | 20 | 140 | ○ | × | ○ |
| 31 | 0.2 | 20 | 160 | × | × | × |
| 32 | 0.5 | 20 | 160 | × | ○ | × |
| 33 | 1.0 | 20 | 160 | × | ◎ | × |
| 34 | 1.5 | 20 | 160 | × | ◎ | × |
| 35 | 2.0 | 20 | 160 | × | ○ | × |
| 36 | 2.5 | 20 | 160 | × | × | × |

Fig.18

| No. | BUMP HEIGHT [μm] | BUMP WIDTH [μm] | BUMP INTERVAL [μm] | IMAGE QUALITY | | JUDGEMENT |
|---|---|---|---|---|---|---|
| | | | | FILMING | PARTIAL DISCOLORATION ETC. | |
| 1 | 1.0 | 5 | 200 | × | ◎ | × |
| 2 | 1.0 | 10 | 200 | ○ | ◎ | ○ |
| 3 | 1.0 | 20 | 200 | ◎ | ◎ | ◎ |
| 4 | 1.0 | 50 | 200 | ◎ | ◎ | ◎ |
| 5 | 1.0 | 70 | 200 | ○ | ◎ | ○ |
| 6 | 1.0 | 100 | 200 | × | ◎ | × |

ELECTROPHOTOGRAPHIC APPARATUS, ELECTROPHOTOGRAPHIC PHOTOCONDUCTOR DRUM, DEVELOPING DEVICE AND IMAGE FORMING DEVICE

The present application is related to, claims priority from and incorporates by reference Japanese Patent Application number 2008-163203, filed on Jun. 23, 2008.

TECHNICAL FIELD

The present invention is related to an electrophotographic apparatus, an electrophotographic photoconductor drum, a developing device and an image forming device.

BACKGROUND

Recently, electrophotographic technology is being widely employed not only in the copier field but also in the printer field, as a high quality image can be instantly obtained with such technology. At the core of the electrophotographic technology is a photoconductor. Particularly, currently an organic photoconductor using an organic photoconductive material that causes no pollution, that can easily form a film and that can be easily manufactured is now popular.

Furthermore, among organic photoconductors, a functionally separated photoconductor that has a photosensitive layer formed by laminating a charge generating layer and a charge transporting layer is widely used. The functionally separated photoconductor is widely used because it provides several advantages over other types of photoconductors. First, it provides high sensitivity due to the combination of a highly effective charge generating substance and charge transporting substance. Second, it exhibits reliable performance and can be manufactured using widely available materials. Third, it is easy to manufacture at reasonable cost.

A mechanism for forming an electrostatic latent image in the functionally separated photoconductor is described. At first, when a photoconductor is photo-irradiated after charging, light passes through a charge transporting layer and is absorbed by a charge generating substance in a charge generating layer, and a charge is thereby generated. Then, the generated charge is injected into the charge transporting layer at an interface between the charge generating layer and the charge transporting layer. The charge then moves through the charge transporting layer to a surface by an electric field and forms the electrostatic latent image by neutralizing the charge on the surface of the photoconductor, as disclosed in Japanese laid-open patent application number 2002-318459.

Present image reproduction applications require high-speed formation of a high-quality picture of an image. To realize such high-speed, high-quality picture formation, toner material must be improved to include an external additive, such as silica, to control charging, to impart liquidity, and to upgrade transferring efficiency.

However, a problem known as "filming," which is a phenomenon by which toner accumulates on a small scratch on the surface of the photoconductor and thereby deteriorates a resulting print image, becomes increasingly obvious when the speed of image formation is increased in a traditional photoconductor. The small scratch is typically generated by an external stress, such as pressure from a cleaning blade, on a surface of the photoconductor, and the number of scratches is sharply increasing as the image formation process becomes faster. Also, micro particles in the external additive in the toner adhere to the scratch and form a core. Filming then occurs as silica that is included in the external additive of the toner adheres to and accumulates in the core. When filming occurs in this manner, the formed image quality is degraded since the toner corresponding to a print image cannot adhere to the corresponding part of the photoconductor and a dead pixel occurs.

The purpose of the present invention is to provide an electrophotographic apparatus, a developing device and an image forming device that can inhibit the occurrence of filming, and that can form a high-quality image at high speed without degrading the image quality, by solving the traditional problems and by forming a plurality of bumps that are sloped with respect to the circumferential direction on the photoconductor surface.

For the purpose, the present invention is related to an electrophotographic apparatus includes, a photoconductor, a plurality of a series of bump portions formed on a surface of the photoconductor, the bump portions having slopes with respect to a circumferential direction of the photoconductor, and each of the bump portions being spaced apart by a predetermined interval from adjacent bump portions with respect to the circumferential direction.

In the present invention, a plurality of bumps that are sloped with respect to the circumferential photoconductor direction are formed successively on a surface of an electrophotographic apparatus. With this configuration, the filming can be prevented, and a high-quality image can be formed at high speed without degrading the image quality.

BRIEF DESCRIPTION OF THE DRAWINGS

FIG. 1A is a cross-section view illustrating a shape of surface of a photoconductor drum body in a first embodiment. FIG. 1B is an enlarged view of the part A of FIG. 1A.

FIG. 2 is a schematic configuration diagram illustrating an image forming device in the first embodiment.

FIG. 9A illustrates a state in which a filming is small and FIG. 9B illustrates a state in which the filming increases.

FIG. 10 is a table showing results of an evaluation test 1 in the first embodiment.

FIG. 17 is a table showing results of an evaluation test 3 in the second embodiment.

FIG. 18 is a table showing results of an evaluation test 4 in the second embodiment.

DESCRIPTION OF THE PREFERRED EMBODIMENT

Figure 3:
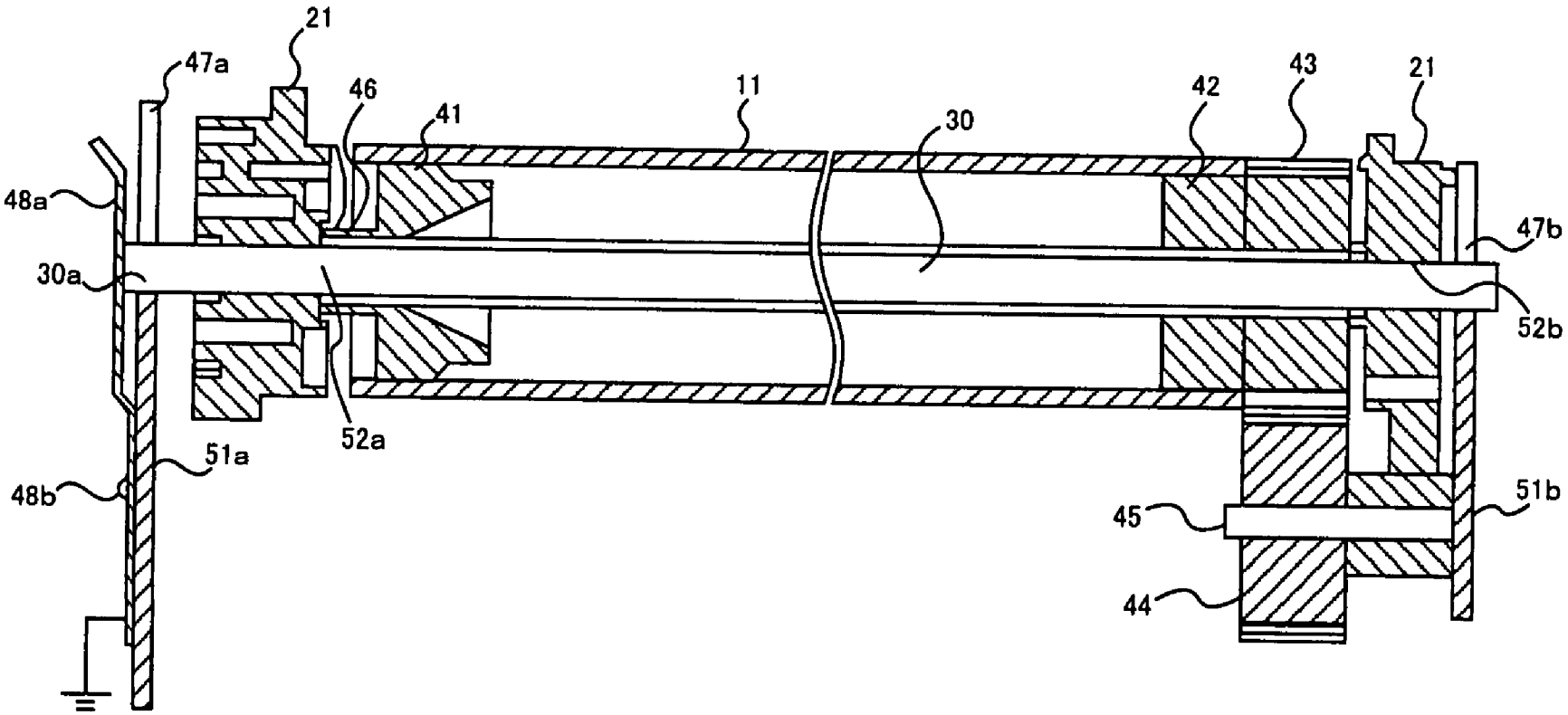
FIG. 3 is a cross-section view illustrating an overall configuration of a photoconductor drum in the first embodiment.

Hereinafter, an embodiment of the present invention is described referring to the drawings.

FIG. 2 is a schematic configuration diagram illustrating an image forming device in the first embodiment.

In the figure, although an image forming device 10 in the present embodiment is, for example, a printer, a facsimile, a copier, or a complex machine that combines several functions, it can be any type of machine that prints with an electrophotographic method using a photoconductor. Also, although the image forming device 10 can be a color printer that executes color printing by arranging an image forming cartridge 20 in multistage format to form an image of each color, a black and white printer that executes one color print (such as black) using a one-color image forming cartridge 20 is described, for convenience of description.

In this case, the image forming cartridge 20 is removably set in the image forming device 10 to operate as a developing device. The image forming cartridge 20 includes a cartridge case 21 formed integrally, and a photoconductor drum 11 as a photoconductor that is drum-shaped and arranged in the cartridge case 21, a charging roller 12 as a charging device that charges the surface of the photoconductor drum 11, a developing unit 13 that develops the surface of the photoconductor drum 11, and a cleaning unit 14 that cleans the surface of the photoconductor drum 11. Although the following will refer to the photoconductor drum 11 as a photoconductor for ease of description, it should be understood that a belt or any other type of device capable of capturing and transferring an image in a manner similar to the photoconductor drum 11 may be used as a photoconductor, as will be described below.

The charging roller 12 contacts the photoconductor drum 11 and is rotatably arranged.

Also, the developing unit 13 includes a developing roller 15 as a developer supporter, a developing blade 16 as a toner layer forming member, a toner supplying roller 17 and an agitating member 18 as developer supplying members, and a toner cartridge 22 is removably placed above. The developing unit 13 develops an electrostatic latent image formed on the surface of the photoconductor drum 11 as an electrostatic latent image supporter by supplying the toner as a developer on the surface of the photoconductor drum 11.

Here, the developing roller 15 has a semiconductive elastic body formed around a conductive shaft, and rotates while abutting to the photoconductor drum 11. Also, the toner supplying roller 17 includes a semiconductive elastic body formed around the conductive shaft. The developing blade 16 thins and charges the toner on the surface of the developing roller 15. In addition, the image forming device 10 in the present embodiment employs a non-magnetic mono-component contact development system, and the toner is a non-magnetic mono-component toner.

The cleaning unit 14 includes a cleaning blade 23 and a spiral screw 24. The cleaning blade 23 scrapes off the residual toner on the surface of the photoconductor drum 11, and the scraped toner is fed to a toner box that is not shown in the figure by the spiral screw 24.

Also, a transferring roller 25 is arranged below the photoconductor drum 11 as a transferring device that transfers the toner on the photoconductor drum to a sheet of paper 31 as a transferred medium.

In the image forming device 10, a paper feeding path 35*a* is arranged to pass through the sheet of paper 31 below the image forming cartridge 20. Also, a paper feeding unit 35*b* that supplies the sheet of paper 31 to the paper feeding path 35*a* includes a hopper stage 32, and sheets of paper 31 are loaded on the hopper stage 32. A spring 33 is arranged below the hopper stage 32, and a sheet of paper 31 on the top is pushed to a feeding roller 34 arranged above by an upward urging force exerted by the spring 33. The sheets of paper 31 loaded on the hopper stage 32 are pulled out sheet by sheet onto the paper feeding path 35*a* as a result of the rotation of the feeding roller 34.

Feeding rollers 36*a* and 36*b* are arranged in the paper feeding path 35*a*, and a sheet of paper 31 pulled out onto the sheet feeding path 35*a* is fed between the photoconductor drum 11 and the transferring roller 25 by the feeding rollers 36*a* and 36*b*.

A fuser 40 is arranged downstream of the paper feeding path 35*a*. The fuser 40 includes a heating roller 40*a* that heats the sheet of paper 31 and a pressure roller 40*b* that pressures the sheet of paper 31. The fuser 40 fuses a toner image onto the sheet of paper 31. Furthermore, ejecting rollers 37*a* and 37*b* are arranged downstream of the fuser 40, and the sheet of paper 31 fused with the toner image is ejected outside the image forming device 10.

Furthermore, the image forming device has a cover 38 attached on the top that rotates around a pivot point 39. A supporting member 26 is arranged below the cover 38, and a light emitting diode (LED) head 28 as an exposing device biased by the supporting member 26 via a spring 27. The LED head 28 includes an LED array consisting of a plurality of LED elements, a substrate that mounts a driver integrated circuit (IC) mounted on a substrate that drives the LED array, a lod lens array that focuses lights produced by the LED element, and so on. A controlling unit of the image forming device 10 that is not shown in the figure drives the LED head 28 on the basis of an image data transmitted from an upper device etc. that is not shown in the figure, lights the LED elements selectively, and forms an electrostatic latent image on the photoconductor drum 11. In addition, the LED head 28 is biased to the photoconductor drum 11 by the spring 27 when the cover 38 is closed.

Next, a mechanism for driving the photoconductor drum 11 is described.

Figure 4:
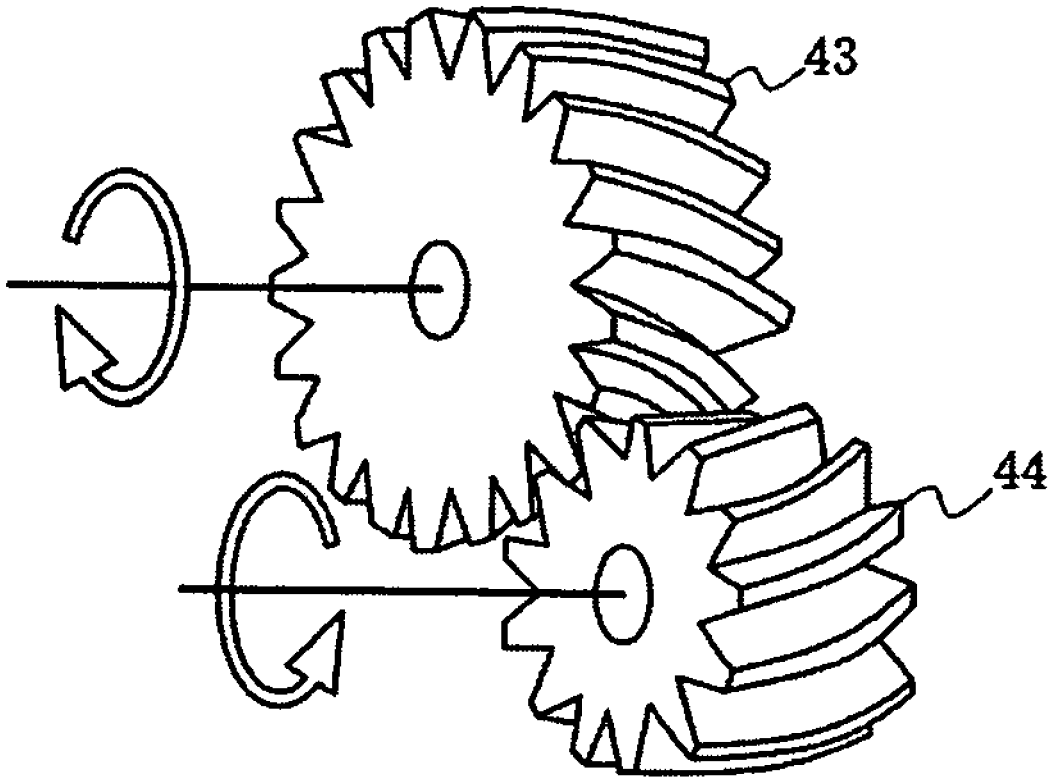
FIG. 4 is a perspective view illustrating a gear in the first embodiment.

FIG. 3 is a cross-section view illustrating an overall configuration of a photoconductor drum in the first embodiment, and FIG. 4 is a perspective view illustrating a gear in the first embodiment.

As shown in FIG. 3, a metallic shaft 30, made from a conductive material, is arranged inside the photoconductor drum 11. Also, a flange 41 is press-fitted and fixed with a nonconductive adhesive on an end inside the photoconductor drum 11. The flange 41 is formed from a conductive synthetic resin made by mixing a synthetic resin (such as a polyamide, a polycarbonate, an acrylonitrile-butadiene-styrene (ABS) resin, or a polyacetal) with conductive powder (such as metallic powder, a carbon black, or graphite). The flange 41 is rotatably attached to the shaft 30.

Also, at the opposite side of the flange 41, a supporting member 42 is arranged inside the photoconductor drum 11.

The supporting member 42 is rotatably attached to the shaft 30 and fixed to inside of the photoconductor drum 11. A gear 43 is fixed with an adhesive outside the supporting member 42. The gear 43 is configured to rotate the photoconductor drum 11 and engages with a driving gear 44 as shown in the figure. The driving gear 44 is rotatably attached to a fixed axis fixed and supported by a device frame 51*b*. When the driving gear 44 is driven by a driving source that is not shown in the figure, the photoconductor drum 11 is rotated via the gear 43.

The shaft 30 and the photoconductor drum 11 are attached to the cartridge case 21 of the image forming cartridge 20. The cartridge case 21 is formed with shaft holes 52*a* and 52*b*, and both ends of the shaft 30 penetrate the shaft holes 52*a* and 52*b*. A collar 46 made of a conductive metal is arranged between the cartridge case 21 and the flange 41 in the left-hand in the FIG. 3. The collar 46 is movable in the direction of the axis of the shaft 30 and is rotatable relative to the shaft 30. The collar 46 is in contact with the flange 41 and the cartridge case 21.

The cartridge case 21 including the shaft 30 and the photoconductor drum 11 is mounted to the device frames 51*a* and 51*b*. The device frames 51*a* and 51*b* have long holes 47*a* and 47*b* respectively, and the cartridge case 21 is mounted by locking both ends of the shaft 30 into the long holes 47*a* and 47*b*. At this time, one end 30*a* of the shaft 30 sticks out from the device frame 51*a*.

Also, a conductive spring member 48*a* is attached by a pin 48*b* outside the device frame 51*a*. The spring member 48*a* is connected to a ground member that is not shown in the figure, and exerts an urging force in an inward direction. When the image forming cartridge 20 is not mounted to the device frame 51*a* and 51*b*, the image forming cartridge 20 can be mounted from above since a top end of the spring member 48*a* inclines outwardly though the spring member 48*a* is located slightly inside of the location shown in the figure. Also, when the image forming cartridge 20 is mounted to the device frames 51*a* and 51*b*, an end 30*a* of the shaft 30 presses against the spring member 48*a*.

As shown in FIG. 4, the gear 43 and the driving gear 44 are helical gears, and twisting angles of the gear teeth are set to be in opposite directions of each other. The gear 43 is biased to the left in FIG. 3 by the helical gear configuration and by the contact between the end 30*a* of the shaft 30 and the spring member 48*a*.

Next, an operation of the image forming device 10 configured as above is described.

When an upper device orders a print start to the image forming device 10 and the upper device transmits image data to the image forming device 10, a controlling unit of the image forming device 10 drives the feeding roller 34 and pulls a sheet of paper 31 out onto the paper feeding path 35*a*. The sheet of paper 31 pulled out onto the paper feeding path 35*a* is fed between the photoconductor drum 11 and the transferring roller 25 by the feeding rollers 36*a* and 36*b*.

Also, the controlling unit drives the LED head 28 on the basis of the transmitted image data, lights the LED elements of the LED head 28 selectively, and exposes the surface of the photoconductor drum 11 previously charged by the charging roller 12. This forms an electrostatic latent image corresponding to the image data on the surface of the photoconductor drum 11. Since the photoconductor drum 11 rotates in the direction shown by an arrow in FIG. 2, the toner on the developing roller 15 adheres to the electrostatic latent image by electrostatic force when the electrostatic latent image arrives at a location corresponding to the developing unit 13. This forms a toner image on the photoconductor drum 11. The toner image moves to the contact location with the transferring roller 25 since the photoconductor drum 11 rotates in the direction shown by the arrow in FIG. 2.

In this case, the toner image arrives at the contact location with the transferring roller 25 at the same time as the sheet of paper 31 arrives between the photoconductor drum 11 and the transferring roller 25, and the toner image is transferred onto the sheet of paper 31 by the transferring roller 25. The sheet of paper 31 including the transferred toner image is fed to the fuser, and the toner image is fused on the sheet of paper 31 as the paper 31 passes between the heating roller 40*a* and the pressure roller 40*b* of the fuser 40. In addition, the sheet of paper 31 including the fused toner image is ejected from the image forming device 10 by the ejecting rollers 37*a* and 37*b*.

Next, a configuration near the surface of the photoconductor drum 11 is described in detail.

Figure 5A:
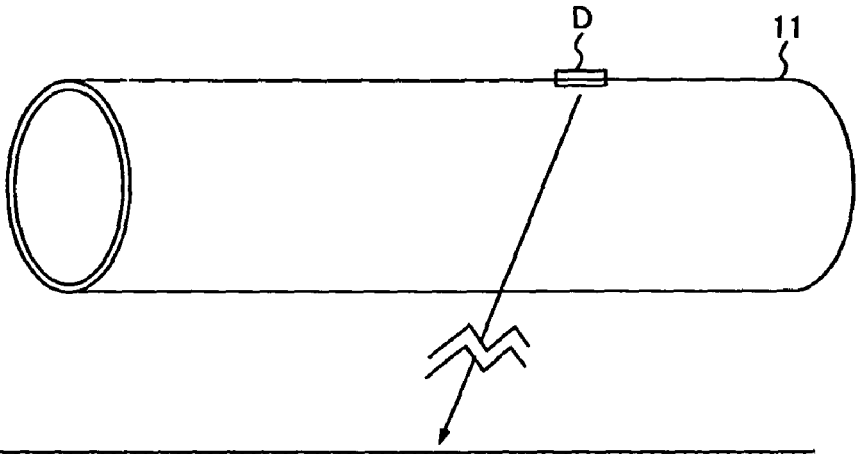
FIG. 5A is a perspective view of the photoconductor drum.
Figure 5B:
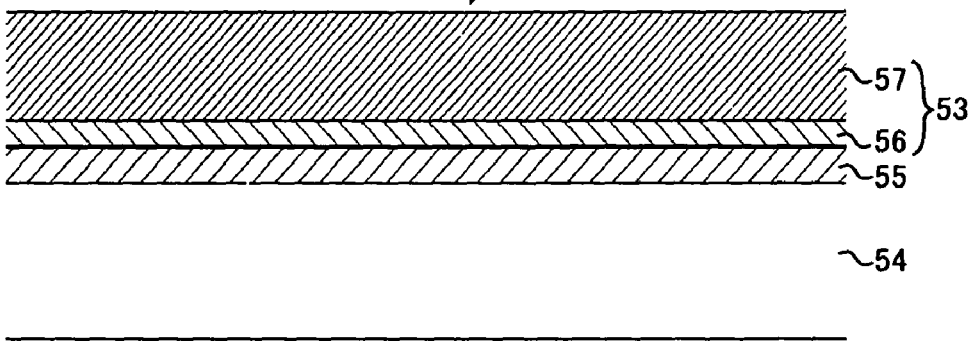
FIG. 5B is a cross-section view illustrating a layer configuration near the surface in the part D of FIG. 5A.
Figure 6A:
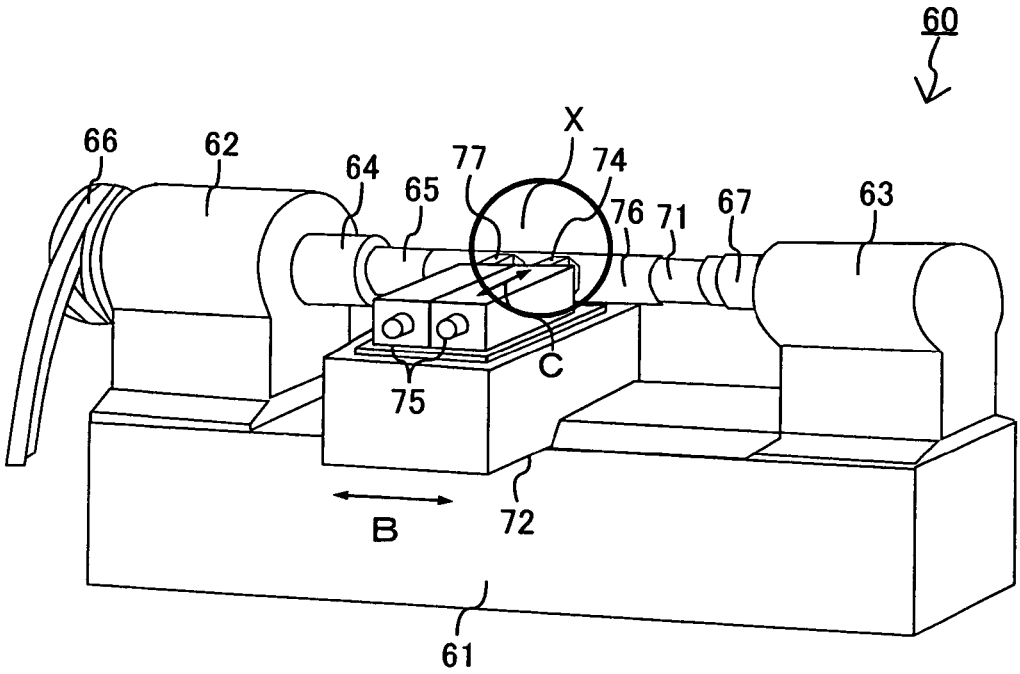
FIG. 6A is a view illustrating a device to process the surface of the photoconductor drum in the first embodiment.
Figure 6B:
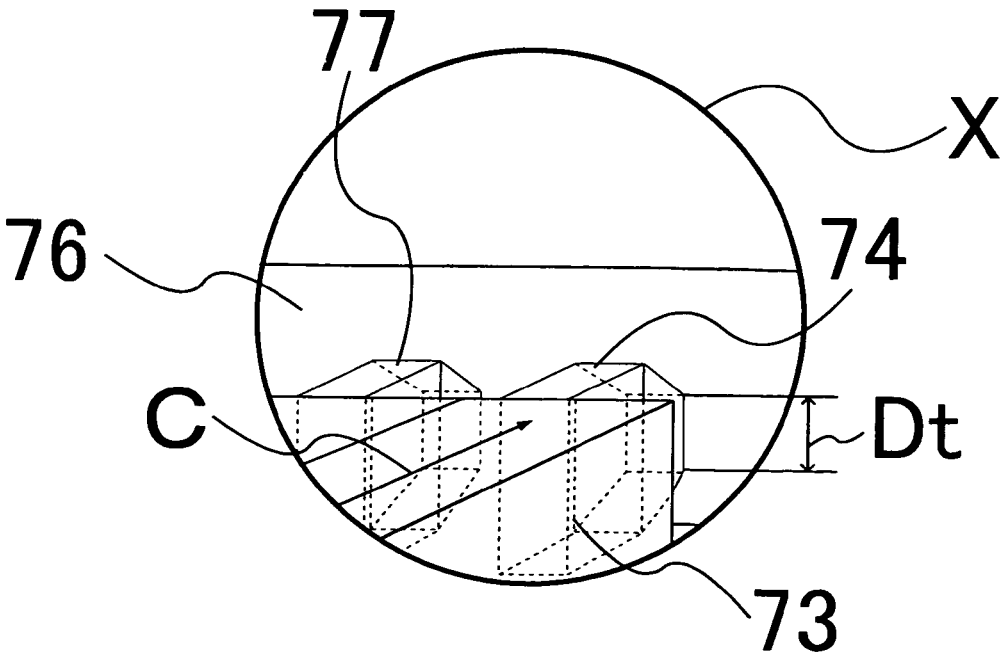
FIG. 6B is an enlarged view of the part X of FIG. 6A.
Figure 7:
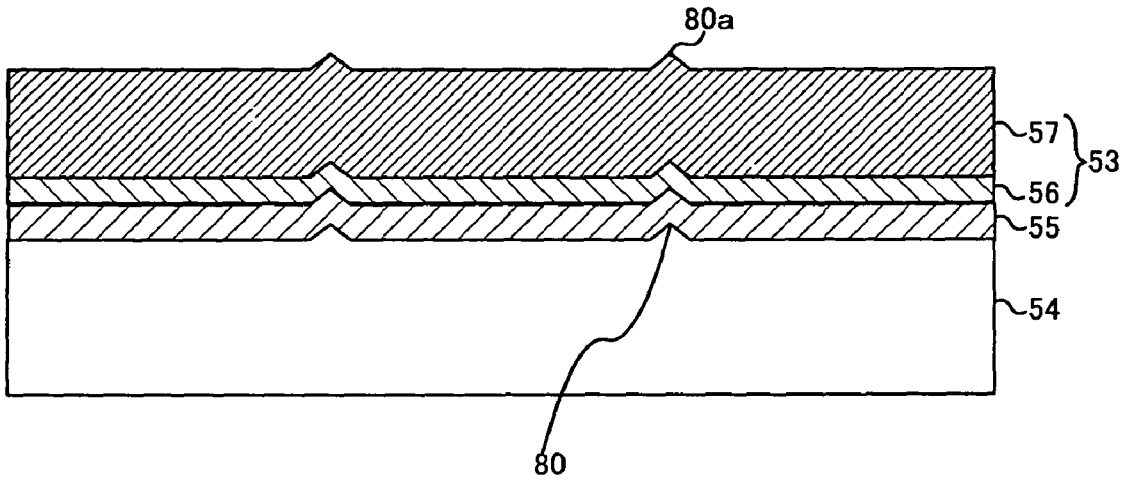
FIG. 7 is a cross-section view illustrating a photosensitive layer formed on the surface of photoconductor drum in the first embodiment.

FIGS. 1A and 1B are a cross-section views illustrating a shape of surface of a photoconductor drum base in a first embodiment of the present invention, FIGS. 5A and 5B are views illustrating a layer configuration near the surface of the photoconductor drum in the first embodiment of the present invention, FIGS. 6A and 6B are views illustrating a device to process the surface of the photoconductor drum in the first embodiment of the present invention, and FIG. 7 is a cross-section view illustrating a photosensitive layer formed on the surface of photoconductor drum in the first embodiment of the present invention. In particular, FIG. 1A is a cross-section view illustrating a part of the base surface cut with respect to the circumferential direction (or cut on a plane orthogonal to the axis direction of the photoconductor drum base), FIG. 1B is an enlarged view of the part A of FIG. 1A, and FIG. 5A is a perspective view of the photoconductor drum and FIG. 5B is a cross-section view illustrating a layer configuration near the surface in the part D.

In the cross-section surface near the surface of the photoconductor drum 11 illustrated in FIGS. 5A and 5B, a base 54 is a drum-shaped, that is, cylindrical, seamless tube of the photoconductor drum 11, and a photosensitive layer 53 is formed on the base 54. The size of the photoconductor drum 11 is determined according to the image forming device 10. For example, an external diameter is approximately 15 mm to 300 mm, and a length is approximately 200 mm to 1,100 mm. Also, a thickness of the base 54 is approximately 0.5 mm to 5 mm.

The base 54 may be made of a metallic material such as aluminum, stainless steel, copper, and nickel. The base 54 may be made of a polyester film that has a conductive layer on the surface, the surface made of a material such as aluminum, copper, palladium, tin oxide, or indium oxide. The base 54 may be made of insulating material, such as paper. However, it is preferable to be made of aluminum or an aluminum alloy. In the present embodiment, the base 54 is described as being made of aluminum or aluminum alloy.

In this case, the base 54 is created from a base material 76 that is a metallic cylindrical tube shown in the FIGS. 6A and 6B. The base material 76 is manufactured by following processes: first, i) extruding a metallic material made of aluminum or aluminum alloy into a cylindrical-shape (such as by a porthall method, or a mandrel method), next ii) drawing the cylindrical material in order to make it a cylinder that has a predetermined thickness, length, external diameter, then iii) conducting other processes such as cutting. In addition, the cylindrical metallic material after extruding is called an extrusion tube, and a cylindrical tube cut into a predetermined length after drawing is called a drawing tube. Generally, advanced working (such as lathe turning, milling, or trimming) is exerted on the extrusion and drawing tubes so as to secure a dimensional accuracy and to eliminate a surface scratch. Furthermore, smoothing is processed for a surface roughness Rz to be 0.3 μm and below by precision cutting using a diamond bite etc.

The surface of the base material 76 obtained as above is further processed by a cutting device 60 shown in FIG. 6A in the present embodiment.

The cutting device 60 includes a bed 61, a headstock 62 and a tailstock 63 fixed on upside of both ends of the bed 61, a main axis 64 extended from the headstock 62, and a chuck jig 65 fixed to the main axis 64. A belt 66 is wound to the main axis 64 via a pulley and rotated by a motor (not shown).

Also, the cutting device 60 includes a tailstock spindle extended from the tailstock 63, a chuck jig 71 fixed at an end of the tailstock spindle, and a saddle 72 that is attached on the bed 61 and in a position between the headstock 62 and the tailstock 63. Further, the saddle 72 is reciprocally attached in the direction indicated by the arrow B.

In addition, a tool rest 73 is attached on the saddle 72 and is movable in a direction perpendicular to the direction that the saddle moves, as shown by the arrow C. Furthermore, cutting tools for finishing and crude processing 74 and 77 are removably attached at front side of the tool rest 73. Also, finger grips 75 for adjusting an amount of cutting are located at a back of the tool rest 73.

When the surface of the base material 76 is processed, the chuck jig 65 is lightly placed in an orifice at an end of the base material 76 and another chuck jig 71 is lightly placed in an orifice at the other end of the base material 76, while the tailstock spindle 67 is brought back. Then, both of the chuck jigs 65 and 71 are lightly pushed to both ends of the base material 76 by lightly pushing out the tailstock spindle 67. Then, the base material 76 is fixed to the main axis 64.

On the other hand, the saddle 72 is moved from the left end in the right direction in FIG. 6A at a constant feeding speed. In this case, the cutting tool for crude processing 77 attached to the tool rest 73 at a preferable height cuts for a certain amount into the base material 76. The saddle is stopped and the cutting tool for crude processing 77 is returned when it moves more than the entire-length of the base material 76. Next, the saddle 72 is moved in the left direction at a constant low feeding speed as the cutting tool for finishing 74 is pressed on the surface of the base material 76 until the saddle 72 returns at the left end that is the initial location. The surface of the base material 76 is finished with the cutting tool for finishing 74 made of a diamond bite by the reciprocating motion of the saddle 72. After the base material 76 is rotated less than a distance "Dt" (shown in FIG. 6B) and the processing above is repeated. Also, an amount of rotation is more than "Dt" at a predetermined location.

By doing this, the base 54 is realized, on which bumps 80 are formed as the plurality of successive bump portions shown in FIGS. 1A and 1B. The bump 80 is convex (or projection) and provides slopes with respect to the circumferential direction. Also, adjacent bumps 80 with respect to the circumferential direction are formed at predetermined intervals. In addition, FIGS. 1A and 1B show a cross-section of a part of the surface of the base 54 with respect to the circumferential direction. The arrow 81 indicates a height of the bump 80, while the arrow 82 indicates the width of the bump 80, and the arrow 83 indicates the interval between the adjacent bumps 80.

The bump 80 is formed at the last step of finishing process of the surface of the base material 76. When in the finishing process, only the bumps 80 are skipped and only a region between the adjacent bumps 80 is cut by the cutting tool for finishing 74. By doing this, the bump 80 is formed at a predetermined interval 83 shown in FIGS. 1A and 1B. In addition, the cutting tool for finishing 74 that is used in the finishing process may be any kind of tool as long as a diamond bit for precision cutting is used for the base surface processing.

Also, though the present embodiment describes a case where the cutting device 60 shown in FIGS. 6A and 6B is used, any other device can be used as well as the cutting device 60, the device that can rotate the base material 76 and move it between right and left, and can process it using a cutting tool.

Furthermore, while the present embodiment describes a case where the bump 80 is formed by processing cutting on the surface of the base material 76, the bump 80 can also be formed by chemically dissolving a predetermined point on the surface of the base material 76 by chemicals, solvents, or agents.

The base 54 is configured as shown in FIG. 7 after a photosensitive layer 53 is formed on the surface of the base 54 that has the bump 80 shown in FIGS. 1A and 1B. As shown in FIG. 7, projections 80*a* as projecting portions are formed on the surface of the photosensitive layer 53 corresponding to the bumps 80 on the surface of the base 54.

A coat under layer 55 may be formed between the base 54 and the photosensitive layer 53 like an example shown in FIGS. 5A, 5B and 7. For example, the coat under layer 55 may consist of an inorganic layer (such as alumite, aluminum oxide, and aluminum hydroxide) or an organic layer (such as polyvinyl alcohol casein, polyvinyl pyrrolidone, polyacrylic acid, celluloses, gelatine, starch, polyurethane, polyimide, and polyamide).

The photosensitive layer 53 shown in examples in FIGS. 5A, 5B and 7 includes a charge generating layer 56 formed on the base 54 sandwiching the coat under layer 55 and a charge transporting layer 57 formed over the charge generating layer 56. The charge generating layer 56 consists mainly of a charge generating substance. The charge transporting layer consists mainly of a charge transporting substance and a binder resin. That is, the photosensitive layer 53 shown in FIGS. 5A, 5B and 7 is a stacked photosensitive layer in which the charge generating layer 56 and the charge transporting layer 57 are stacked in sequence on the base 54. In addition, the photosensitive layer 53 may be stacked so that the charge generating layer 56 and the charge transporting layer 57 are stacked in reverse order. In other words, an inverted bilayer photosensitive layer may be useful in which the charge transporting layer 57 is stacked over the base 54, and the charge generating layer 56 is stacked over the charge transporting layer 57. Also, the photosensitive layer 53 may be a dispersed photosensitive layer in which the charge generating substance is dispersed in the charge transporting layer 57.

When the photosensitive layer 53 is the stacked photosensitive layer or the inverted bilayer photosensitive layer, the charge generating substance used as the charge generating layer 56 can use an inorganic photoconductive substance (such as selenium and its alloy, arsenic selenide compound, cadmium sulfide, or zinc oxide), and several kinds of organic pigment and dye (such as phthalocyanine, azo color, quinacridone, polycyclic quinone, pyrylium salt, thiapyrilium salt, indigo, thioindigo, anthoanthorone, pyranthrone, or cyanine). Above all, a metal and its oxide (such as metal-free phthalocyanine, copper indium chloride, gallium chloride, tin, oxititanium, zinc, vanadium), phthalocyanines in which chlorides are coordinated, and azo pigment (such as monoazo, bis-azo, tris-azo, poly-azos) are preferable to be used.

The charge generating layer 56 may be a dispersion layer in which microparticles of these charge generating substances are bound by several kinds of binder resin such as polyester resin, polyvinyl acetate, polyacrylic acid ester, polymethacrylic acid ester, polyester, polycarbonate, polyvinyl acetacetal, polyvinyl propional, polyvinyl butyral, phenoxy resin, epoxy resin, urethane resin, cellulosic ester, cellulosic ether, etc. A use ratio of the charge generating substance in this case falls within a range from 30 to 500 weight percent for 100 weight percent of the binder resin, and a film thickness of the layer is usually suitable to be from 0.1 μm to 2 μm.

The charge generating layer 56 may include several kinds of additive agents so as to improve an application property as needed, the agents such as a leveling agent, an antioxidant, a radiosensitizing agent, etc. Also, the charge generating layer 56 may be an evaporated film of the charge generating substance.

Also, the charge transporting substance used in the charge transporting layer 57 is an electron-releasing substance that is, for example, a heterocyclic compound (such as carbazole, indole, imidazole, oxazole, pyrazole, oxadiazole, pyrazoline, or thiadiazole), aniline derivative, hydrazone compound, aromatic amine derivative, or stilbene derivative. Further, the charge transporting substance may be a polymer that has a radical consisting the above compounds as a main chain or a side chain.

The binder resin used in the charge transporting layer 57 may be a vinyl polymer (such as polycarbonate, polymethylmethacrylate, polystyrene, or polyvinyl chloride), polyester, polyester carbonate, polysulphone, polyimide, phenoxy, epoxy, or silicon resin. Further, for the binder resin, a copolymer of these substances or a partial crosslink hardened material etc. can be used singularly or as a mixture. In particular, polycarbonate is suitable.

Also, the charge transporting layer 57 may include several kinds of additive agents, such as an antioxidant, a radiosensitizing agent, etc., as needed. The film thickness of the charge transporting layer 57 is usually from 5 μm to 30 μm.

When the photosensitive layer 53 is the dispersed photosensitive layer, the charge generating substance is dispersed with a combination of the binder resin and the charge transporting substance in the charge transporting medium at the compounding ratio mentioned above. In this case, the particle size of the charge generating substance needs to be, for example, 1 μm or below.

An amount of the charge generating substance distributed into the photosensitive layer 53 preferably falls in a range from 0.5 to 50 weight percent since a sufficient sensitivity can not be obtained when it is too short, and a negative effect occurs such as a reduction of charging, a reduction of sensitivity, etc. when it is too much. The thickness of the photosensitive layer 60 is preferable from 5 to 30 μm. Also, the following can be added: a common plasticizer for improving a film-formability, a flexibility, or a mechanical strength, etc., an additive agent for inhibiting a residual potential, a dispersion agent for dispersion stability upgrading, a leveling agent for improving the application property, a surfactant such as silicon oil, and other additive agents.

In addition, a common method can be applied as a method for forming each layer, such as applying in sequence an application liquid that is obtained by dissolving or dispersing a substance to be included in the layer into a solvent.

Next, an example of an experiment in the present embodiment is described.

Figure 8:
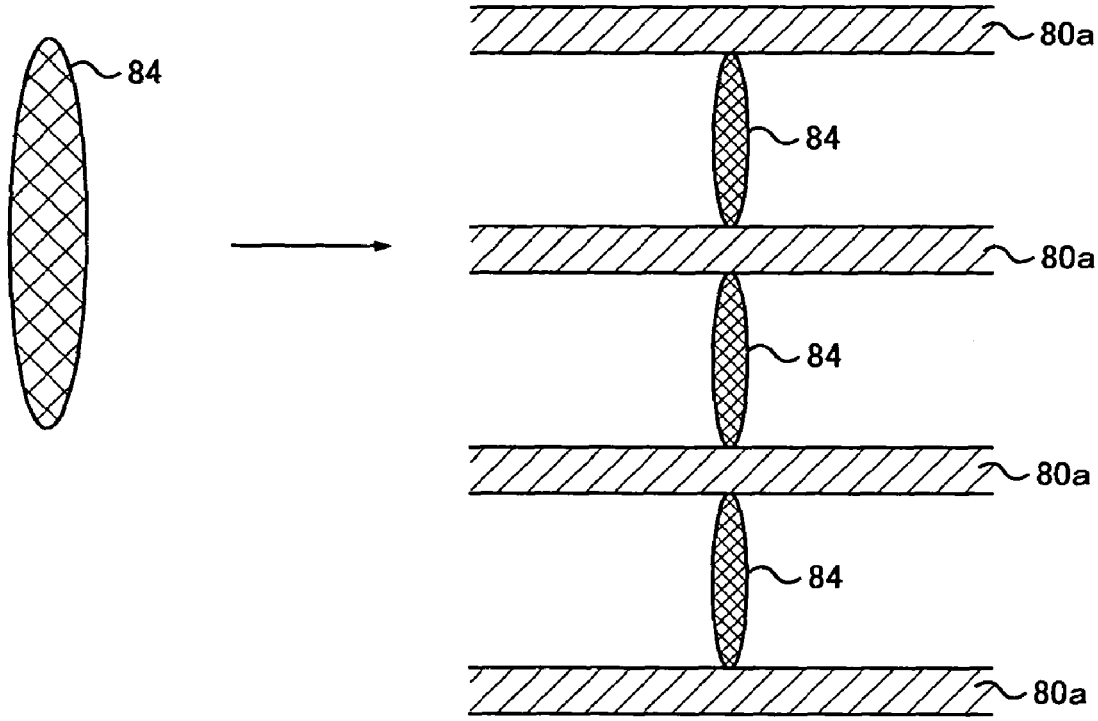
FIG. 8 is a top view illustrating occurring of a filming in the first embodiment.
Figure 9A:
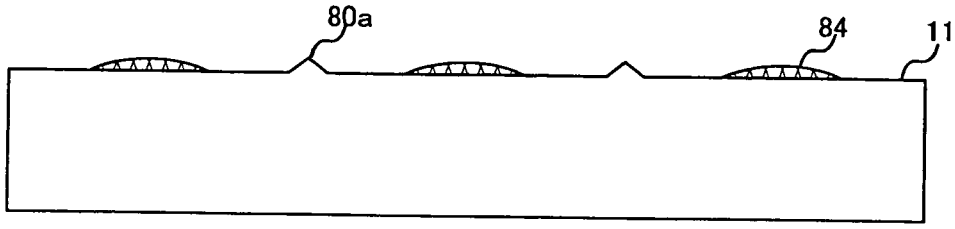
FIG. 9A and FIG. 9B are side views illustrating the occurrence of filming in the first embodiment. Specifically.
Figure 9B:
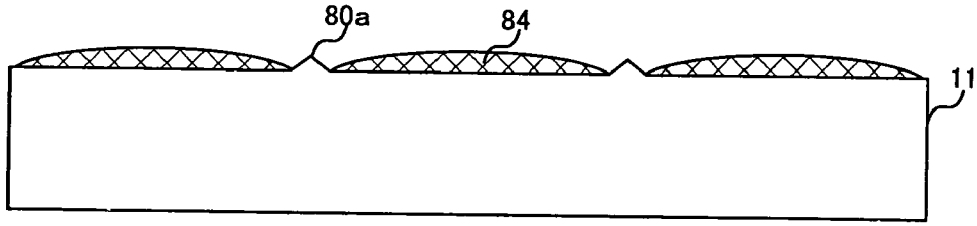
Figures 11, 12:
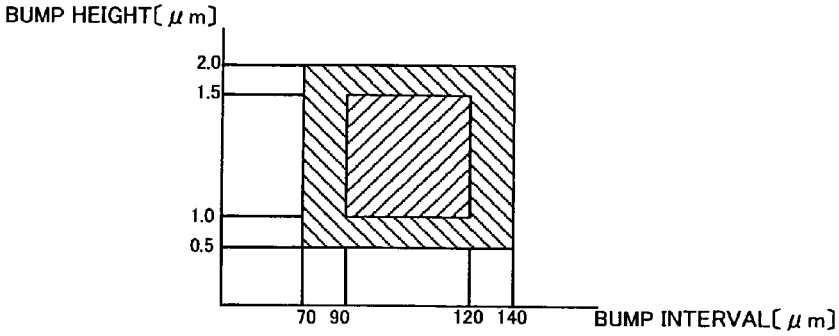
FIG. 11 is a graph showing a range of a good quality image on the basis of the evaluation test 1 in the first embodiment.
FIG. 12 is a table showing results of an evaluation test 2 in the first embodiment.
Figure 13:
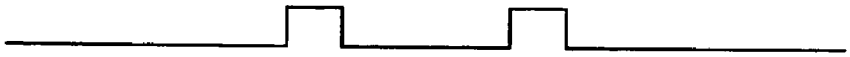
FIG. 13 is a view illustrating a modification of a bump portion of the photoconductor drum in the first embodiment.

FIG. 8 is a top view illustrating the occurrence of a filming in the first embodiment, FIGS. 9A and 9B are side views illustrating the occurrence of filming in the first embodiment, FIG. 10 is a table showing results of an evaluation test 1 in the first embodiment, FIG. 11 is a graph showing a range of good quality image on the basis of the evaluation test 1 in the first embodiment, FIG. 12 is a table showing results of an evaluation test 2 in the first embodiment, and FIG. 13 is a view illustrating a modification of a bump portion of the photoconductor drum in the first embodiment. In addition, FIG. 9A illustrates a state in which a filming is small, and FIG. 9B illustrates a state in which filming increases.

In the present embodiment, sequential printing (or a plurality of printings) was conducted with a photoconductor drum 11 of which a height 81, a width 82, and an interval 83*a* varied and C5900dn made by Oki Data Corporation as an image forming device 10 in order to set an optimal value of the height 81, the width 82, and the interval 83 of the bumps 80 shown in FIGS. 1A and 1B.

At first, the occurrence of filming is described.

A filming 84 occurs on a surface of a photosensitive layer of the photoconductor drum 11 in FIGS. 8, 9A, and 9B. The filming 84 occurs in the process of using the photoconductor drum 11. First, a tiny scratch on the surface of the photosensitive layer 53 is formed because of friction with a roller (such as a charging roller 12, a developing roller 15, or a transferring roller 25) and a blade (such as a cleaning blade 23). Second, silica included in an external additive of a toner is attached to paper power stacked on the scratch. Then, the stacked silica on the scratch grows using the stacked paper power as a starting point.

Therefore, the present embodiment forms a projection 80*a* on the surface of the photosensitive layer 53, and inhibits growth of a filming 84 by interrupting the growing of the filming 84 by the projection 80*a*. FIG. 8 shows a plurality of projections 80*a* ending the growth of the filming 84. The bumps 80 are formed in a predetermined interval with respect to a circumferential direction. Also, FIG. 9A shows the occurrence of small filming 84 on the surface of the photosensitive layer 53 at first, and FIG. 9B shows the interrupting of the increased filming 84 by the plurality of projections 80*a* formed in a predetermined interval with respect to the circumferential direction. As above, the filming 84 can be inhibited by forming the projections 80*a* on the surface of the photosensitive layer 53.

Incidentally, the height of the projections 80*a* has an optimal value. When the projections 80*a* are too low, they cannot effectively interrupt the growing of the filming 84. On the other hand, when the projection 80*a* is too high, a shape corresponding to the projection 80*a* is formed on a print surface, and an image quality of the print deteriorates. In addition, in the present embodiment, the projection 80*a* on the photosensitive layer 53 is formed by forming a bump 80 on the base 54. Therefore, the height of the projection 80*a* on the surface of the photosensitive layer 53 is somewhat low in comparison to the height 81 of the bump 80 on the surface of the base 54.

Similarly, the width of the projection 80*a* also has an optimal value. When the width of the projection 80*a* is too narrow, the manufacturing process is extremely difficult. When it is too wide, the inhibiting effect on the filming 84 (or advantages of the bump 80) deteriorates. Also, the interval between the adjacent projections 80*a* has an optimal value. When the interval between the adjacent projections 80*a* is too narrow, the inhibiting effect on the filming 84 deteriorates. When the interval between the adjacent projections 80*a* is too wide, the filming 84 occurs between the projections 80*a*.

Therefore, the present embodiment performs an evaluation test of a formed image by continuous printing using C5900dn made by Oki Data Corporation as described above. In particular, a continuous printing is executed intermittently on 12000 A4 sheets of paper 31 using a toner including silica as an external additive under a low-temperature low-humidity environment of 10 degrees in temperature and 20% in humidity. The continuous printing employs a transverse band pattern of 3% in pattern density. Also, after the continuous printing, an image evaluation is executed by printing of 100% in pattern density for each color, that is, black, magenta, and cyan.

The evaluation of an image quality is executed visually for the filming 84, and configured to be marked with a double circle (◎) when no pinhole defect occurs on the image at all due to the filming 84, marked with a single circle (○) when the pinhole defect occurs less than 5% of the image area and can not be recognized without observing closely, and marked with a cross (x) when the occurring of the pinhole defect is recognized to be 5% or more of the image area.

Also, as for a color unevenness, a density difference at an arbitrary point on the image is measured by a density meter X-Rite, and configured to be marked with a double circle when a measured value is less than 0.1, marked with a single circle when it is 0.1 or more and less than 0.2, and marked with a cross when it is 0.2 or more.

As an evaluation test 1, an image evaluation is performed configuring a height 81 of the bump 80 to be from 0.2 μm to 2.5 μm, an interval 83 to be from 40 μm to 160 μm, and a width 82 to be 20 μm. The results of the evaluation test 1 are displayed as a list in FIG. 10.

From the results shown in FIG. 10, the height 81 of the bump 80 can be seen that it is appropriate from 0.5 μm to 2.0 μm, and preferably, it is optimal from 1.0 μm to 1.5 μm. Also, the interval 83 of the bump 80 can be seen that it is appropriate from 70 μm to 140 μm, and preferably, it is optimal from 90 μm to 120 μm.

And, FIG. 11 illustrates a good range of image quality and an optimal range of image quality obtained from the results shown in FIG. 10. In FIG. 11, a central shaded part is a region that shows the optimal range of image quality, and a surrounding shaded part is a region that shows the good range of image quality.

Next, as an evaluation test 2, image evaluation is performed configuring a width 82 of the bump 80 to be from 5 μm to 100 μm, the height 81 to be 1.0 μm, and the interval 83 to be 200 μm. The results of the evaluation test 2 are displayed as a list in FIG. 12.

From the results shown in FIG. 12, the width 82 of the bump 80 can be seen that it is appropriate from 10 μm to 70 μm, and preferably, it is optimal from 20 μm to 50 μm.

In addition, a shape of the bump 80 on the surface of the base 54 is not necessarily an inverted V-shape shown in FIG. 1. For example, when it is an inverted U-shape shown in FIG. 13, it is similarly effective for inhibiting the occurrence of the filming 84. It is because a shape of the surface of the photosensitive layer 53 does not vary as long as the width 82 of the bump 80 is the same even if the shape is different.

As mentioned above, in the present embodiment, a bump 80 is formed on a surface of a base 54 in a predetermined interval 83 by cutting, and a shape of the bump 80 is maintained until after an upper layer of a photosensitive layer 53 is applied to form a projection 80*a* also on an upper surface of the photosensitive layer 53. This can inhibit growth of adhering matter by a filming 84 on the photosensitive layer 53.

As for the occurrence of the filming 84 on the photoconductor drum 11, various factors can be considered, such as a material used in a coat under layer 55 and a charge generating layer 56, or an electrical property relating to a charging of the photosensitive layer 53 in an electrophotographic process, etc. An inventor of the present invention focused on an adhering matter growing process, and found an inhibiting method of the filming 84 that has broad utility without regard to the material used in the photosensitive layer 53. Previously, when a measure of inhibiting the occurrence of the filming 84 was implemented, samples varying the materials of a coat under layer 55, a charge transporting layer 57, a charge generating layer 56, etc. needed to be made and evaluated. However, the inventor of the present invention found that a processing method of the base 54 can be elaborated, and a reduction of development costs for the photoconductor drum 11 can be realized.

Next, a second embodiment of the present invention is described. In addition, an identical configuration to a first embodiment is assigned the identical reference numbers and corresponding description is omitted. Also, an identical operation and an identical effect to the first embodiment is omitted from the description.

Figure 14:
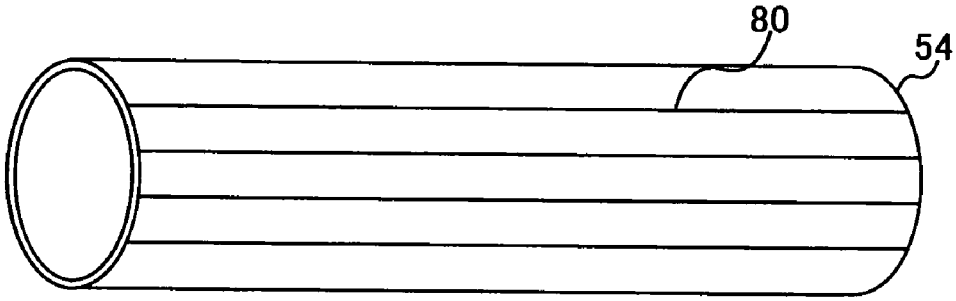
FIG. 14 is a perspective view illustrating a first shape of the surface of the photoconductor drum base in the second embodiment.
Figure 15:
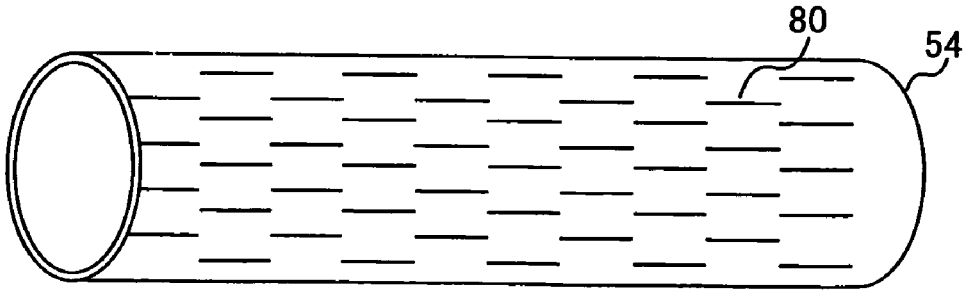
FIG. 15 is a perspective view illustrating a second shape of the surface of the photoconductor drum base in the second embodiment.
Figure 16:
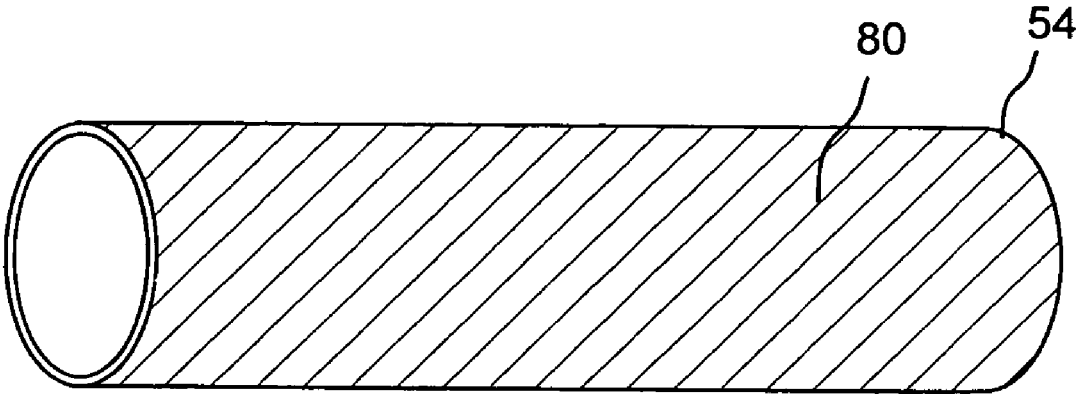
FIG. 16 is a perspective view illustrating a third shape of the surface of the photoconductor drum base in the second embodiment.

FIG. 14 is a perspective view illustrating a first type of the surface of the photoconductor drum body in the second embodiment of the present invention, FIG. 15 is a perspective view illustrating a second type of the surface of the photoconductor drum body in the second embodiment of the present invention, and FIG. 16 is a perspective view illustrating a third type of the surface of the photoconductor drum body in the second embodiment of the present invention.

As shown in FIGS. 14 to 16, a bump 80 is formed on a surface of a base 54 by cutting in the present embodiment as well as in the first embodiment. In an example shown in FIG. 14, the bump 80 extends on a base 54 as a seamless tube in a direction of a shaft, and is successively formed without interruption. Also, in the example shown in FIG. 15, the bump 80 extends on the base 54 in the direction of the shaft, and is intermittent, that is, formed intermittently and discontinuously. Furthermore, in the example shown in FIG. 16, the bump 80 extends in a slope with respect to the direction of the shaft of the base 54, and is formed in a spiral-shape.

In addition, although the bump 80 shown in FIG. 14 is formed in a shape similar to the bump 80 in the first embodiment, the shape of the bump 80 is not limited to the shape shown in FIG. 14 as long as the height 81, the width 82, and the interval 83 satisfy a condition described in the first embodiment, and may be the shape shown in FIG. 15 or 16.

The spiral-shaped bump 80 as shown in FIG. 16 can be shaped without skipping a cutting tool for finishing 74 at the last step of finishing process (namely, by maintaining the cutting tool in contact) on the surface of the base material 76. This can shorten the processing time.

The other point of a configuration of an image forming device 10 in the present embodiment is similar to the first embodiment, so the description of it is omitted.

Next, an example of experiment in the present embodiment is described.

FIG. 17 is a table showing results of an evaluation test 3 in the second embodiment, and FIG. 18 is a table showing results of an evaluation test 4 in the second embodiment.

In the present embodiment, an evaluation test 3 is performed in an identical condition to the evaluation test 1 in the first embodiment, and the evaluation test 4 is performed in an identical condition to the evaluation test 2 in the first embodiment. The results of the evaluation tests 3 and 4 are displayed as lists in FIGS. 17 and 18, respectively. It can be seen that an inhibiting effect for a filming 84 similar to the first embodiment can be obtained in the present embodiment from FIGS. 17 and 18.

As above, in the present embodiment, making the bump 80 spiral-shaped as shown in FIG. 16 enables the base 54 to process without moving the cutting tool for finishing 74 several hundred times in the cutting process of the base 54, and enables the processing time to be significantly shorten.

Although a bump (or bump portion) is formed on a base, the bump may be formed only on each halfway layer and a surface, not on the material, and may appear on the drum surface eventually.

In addition, although an example of a printer is described as an image forming device 10 using an electrophotographic apparatus in the first and second embodiment, the present invention can be applied to other types of image forming devices using the electrophotographic apparatus, such as a copier, a fax machine, etc.

Also, the present invention is not limited to the described herein embodiments, but it can be varied based on a purpose of the present invention, while remaining within the scope of the present invention.

What is claimed is:

1. An electrophotographic apparatus comprising:
a photoconductor;
a plurality of a series of bump portions formed on a surface of the photoconductor;
the bump portions having slopes with respect to a circumferential direction of the photoconductor; and
each of the bump portions being spaced apart by a predetermined interval from adjacent bump portions with respect to the circumferential direction,
wherein the bump portions are convex in shape,
wherein a height of the bump portions is in a range from 0.5 μm to 2.0 μm,
wherein a width of the bump portions is in a range from 10 μm to 70 μm, and
wherein an interval between the adjacent bump portions is in a range from 70 μm to 140 μm.

2. The electrophotographic apparatus of claim 1, wherein the photoconductor comprises a base formed from a metallic material, and a photosensitive layer is formed on the base.

3. The electrophotographic apparatus of claim 2, wherein the metallic material is aluminum.

4. The electrophotographic apparatus of claim 2, wherein the bump portions are formed on the base.

5. The electrophotographic apparatus of claim 1, wherein a sequence of the bump portions is intermittent.

6. The electrophotographic apparatus of claim 1, wherein the bump portions each have a predetermined length.

7. The electrophotographic apparatus of claim 1, wherein
a conductive base, a coat under layer, a charge generating layer, and a charge transporting layer are respectively layered on the photoconductor.

8. A developing device, comprising the electrophotographic apparatus of claim 1.

9. An image forming device, comprising the electrophotographic apparatus of claim 1.

10. The electrophotographic apparatus of claim 1, wherein
the adjacent bump portions are formed in parallel with each other.

11. The electrophotographic apparatus of claim 1, further comprising:
a plurality of projections formed on a surface of a photosensitive layer.

12. The electrophotographic apparatus of claim 1, further comprising:
a plurality of projections formed on a surface of a charge transporting layer.

13. The electrophotographic apparatus of claim 1, further comprising:
a plurality of projections formed on a surface of a charge generating layer.

14. An electrophotographic photoconductor drum for an image forming device, the electrophotographic photoconductor drum comprising:
a cylindrical base;
a plurality of a series of bump portions formed on a surface of the base; and
a photosensitive layer laminated on the base, wherein
the photosensitive layer has a series of projecting portions on its surface corresponding to the bump portions formed on the base, and
wherein the bump portions are convex in shape, and
wherein a height of the bump portions is in a range from 0.5 μm to 2.0 μm.

15. The electrophotographic photoconductor drum of claim 14, further comprising a coat under layer sandwiched between the base and the photosensitive layer.

16. The electrophotographic photoconductor drum of claim 15, wherein the photosensitive layer comprises a charge generating layer formed over the coat under layer and a charge transporting layer formed over the charge generating layer.

17. The electrophotographic photoconductor drum of claim 15, wherein a width of the bump portions is in a range from 10 μm to 70 μm.

18. The electrophotographic photoconductor drum of claim 15, wherein an interval between the adjacent bump portions is in a range from 70 μm to 140 μm.

* * * * *